United States Patent [19]

Lucas

[11] 4,232,785

[45] Nov. 11, 1980

[54] RAZOR STORAGE

[75] Inventor: Michael P. Lucas, Hingham, Mass.

[73] Assignee: The Gillette Company, Boston, Mass.

[21] Appl. No.: 764,035

[22] Filed: Jan. 31, 1977

[51] Int. Cl.[3] ..... B65D 69/00; A45D 27/22; B65D 85/00

[52] U.S. Cl. ..... 206/228; 132/80 R; 215/100 R; 215/DIG. 5; 220/85 R; 220/85 P

[58] Field of Search ..... 220/85 R, 85 P; 206/228, 229; 215/100 R, DIG. 5; 132/80 R

[56] References Cited

U.S. PATENT DOCUMENTS 3,732,591 5/1973 Gach ..... 215/100 R 3,754,326 8/1973 Glaberson ..... 206/228

FOREIGN PATENT DOCUMENTS 1087491 2/1955 France ..... 215/DIG. 6

*Primary Examiner*—George E. Lowrance

[57] ABSTRACT

A razor storage arrangement includes a container with a protective cover over a dispensing opening at the upper end of the container. A razor is releasably retained on the container with the head of the razor in a recess in the cover and a razor handle extending downwardly below the container along the side of the container.

16 Claims, 9 Drawing Figures

FIG 1
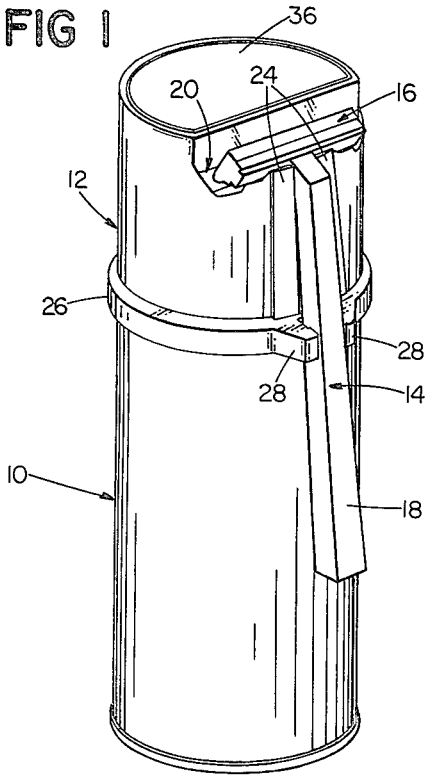
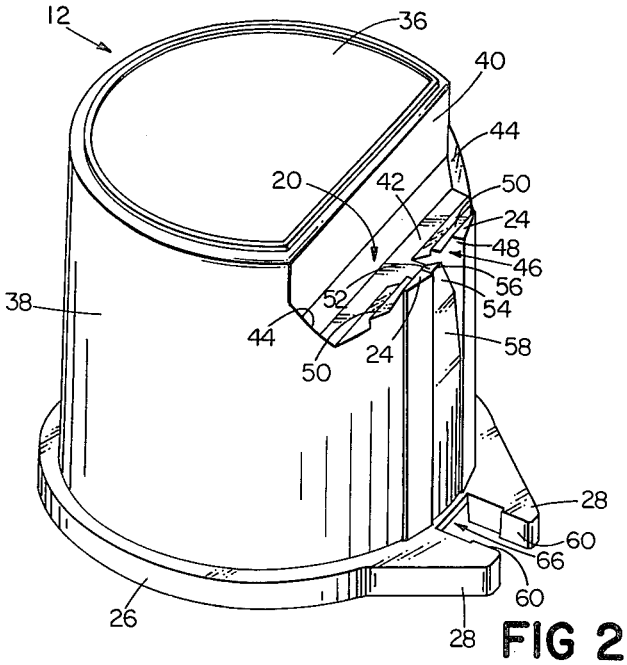
FIG 2
FIG 3
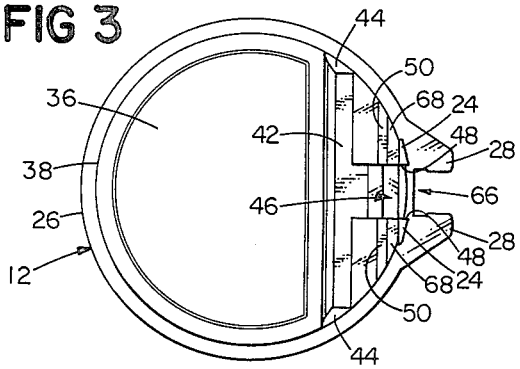
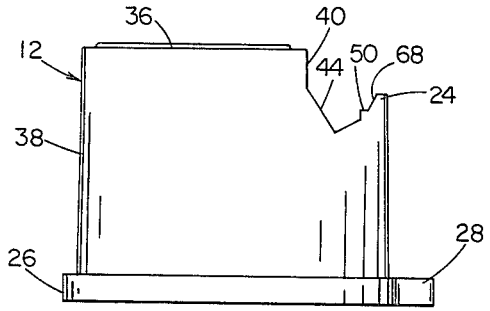
FIG 4
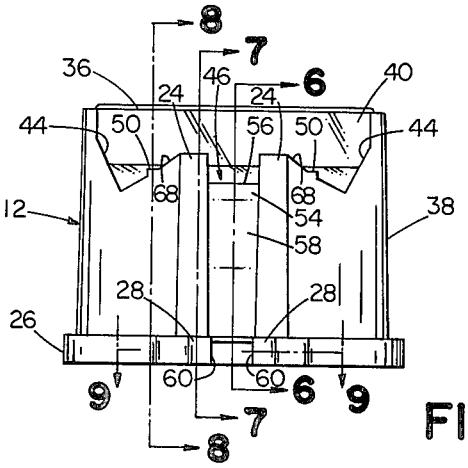
FIG 5

RAZOR STORAGE

SUMMARY OF INVENTION

This invention relates to razor storage arrangements, and more particularly to a razor storage arrangement that includes a container cover.

Among the numerous razor storage arrangements that have been proposed are a variety of containers that have removable or hinged covers or lids in which the razor and cooperating blades or blade units may be stored. Other proposed arrangements include a container of the aerosol type which has an internal upwardly extending auxiliary recess in the container which receives a razor (U.S. Pat. No. 3,426,769) and an adapter arrangement for an aerosol container in the form of an auxiliary collar that is carried by the container below a protective cover and has an elongated yoke that receives a razor handle (U.S. Pat. No. 3,272,323).

In accordance with one aspect of the invention there is provided a composite razor storage arrangement that includes a container with a dispensing opening at its upper end, a cover for removable securance to the container in protective position over the dispensing opening, and a razor that has an elongated handle and a head at one end of the handle, the head having portions that extend laterally from either side of the handle for support of a transversely extending shaving edge. The cover includes a recess for the head of the razor with the razor handle extending downwardly along the side of the container and structure integral with the cover and complementary with the razor for retaining the razor in releasable supported relation on the container.

In a particular embodiment the cover recess is in the form of a transversely extending well into which the head of the razor is received. A support surface is provided adjacent the outer edge of the well on which the razor head is seated, with an upstanding retention member that is outward of and projects above the support surface. The cover also includes two integral spaced members that project in a generally horizontal outward direction and are adapted to receive the razor handle therebetween. Preferably the projections are at the base of the cover and extend outwardly from structure for coupling the cover to the container and are spaced to provide an interference fit with the handle to supplement securing of the razor to the cover by the retention member. This cover is a simple, inexpensive cover of molded plastic or the like, is complementary to upper portions of a conventional product dispensing container, and is compatible with and is easily removed for normal use of the container on which it is mounted.

In preferred embodiments the cover is manufactured inexpensively in a simple molding operation and provides a compact storage arrangement for razors of the replaceable blade unit type in which the razor head is disposed entirely within the well, the blade edge or edges are protected against damage as the razor is inserted into or removed from storage, and the razor is securely retained on the container in storage. The cover of the invention may be sold separately for attachment by a purchaser to a dispensing container in combination with a dispensing package, or as a component of a composite product that includes a razor and a consumer product such as shave cream. Where such a composite product is sold, a securing sleeve may be employed over the razor and container to assure retention of the razor on the container during shipment.

Other features and advantages of the invention will be seen as the following description of a particular embodiment progresses, in conjunction with the drawings, in which:

FIG. 1 is a perspective view of a dispensing container and cover with a razor supported thereon in accordance with the invention;

FIG. 2 is another perspective view of the cover shown in FIG. 1;

FIGS. 3, 4 and 5 are top, side and front views, respectively, of the cover shown in FIG. 1;

Figure 6:
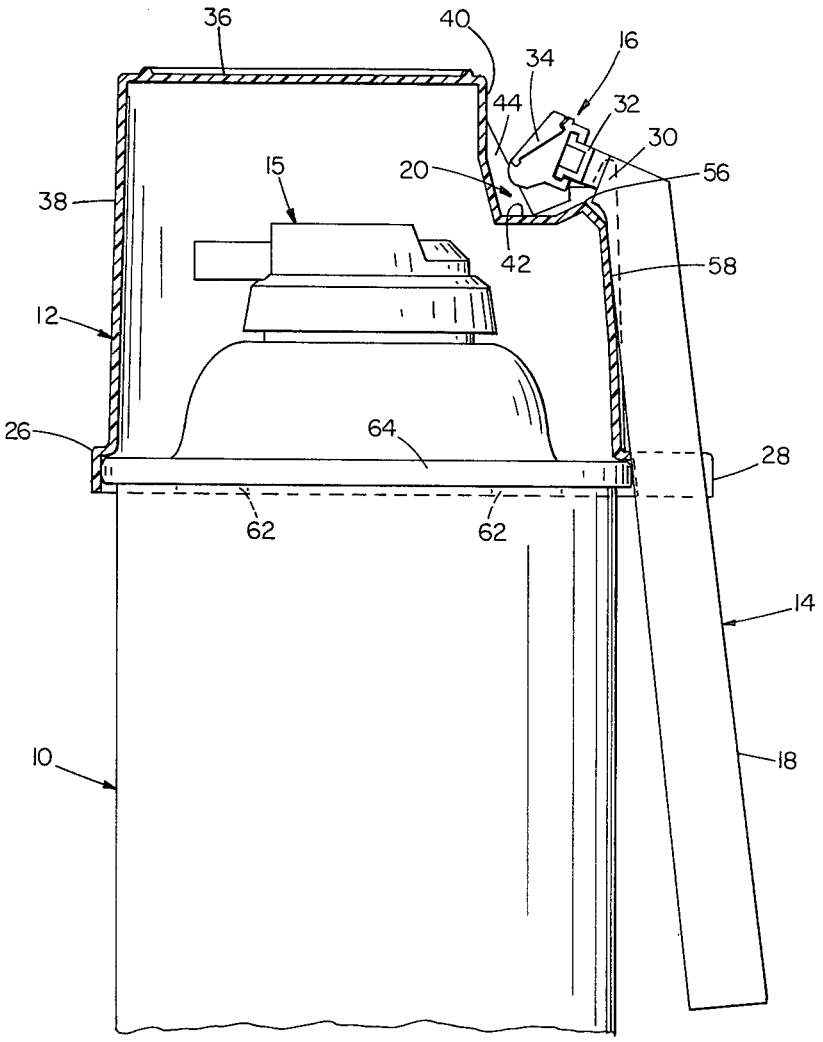
Figure 7:
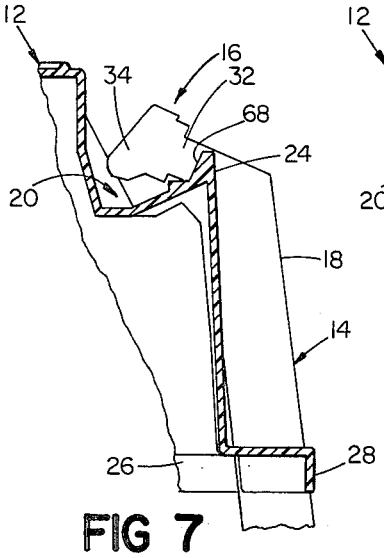
Figure 8:
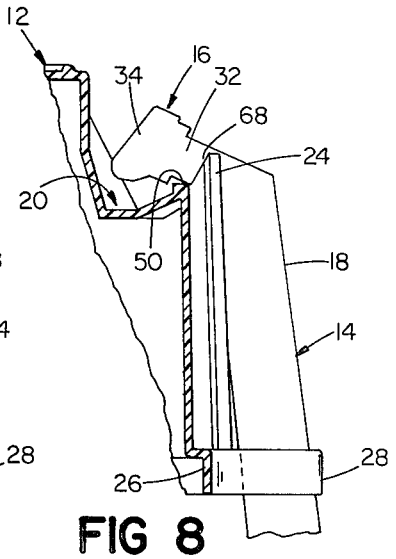
Figure 9:
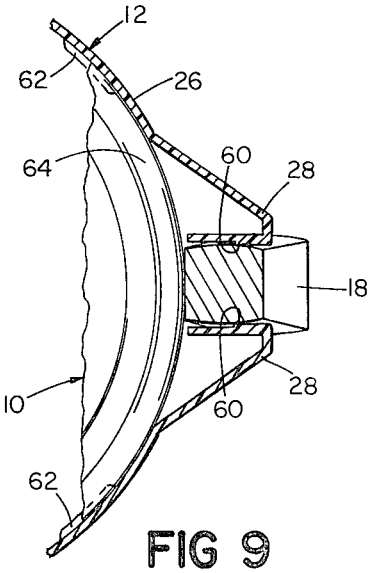

FIG. 6 is a side elevational view of portions of the dispensing container and razor in elevation and with the portions of the cover broken away; and FIGS. 7, 8 and 9 are sectional views taken along the lines 7—7, 8—8 and 9—9, respectively, of FIG. 5 showing the accommodated razor.

DESCRIPTION OF PARTICULAR EMBODIMENT

With reference to FIG. 1 there is shown a shave cream dispensing package that includes a cylindrical container generally designated 10 of conventional pressurized dispensing type and a protective cover 12 removably positioned over the upper end of container 10. Cover 12 encloses a valve operating and dispensing spout mechanism 15 (shown in FIG. 6) and is removed for a dispensing operation and replaced in the protective covering relation shown in FIG. 1 after a shave cream dispensing operation has been completed.

A razor generally designated at 14 is supported on the covered container and has a transverse head portion 16 that carries a shaving edge and an elongated handle portion 18 that extends downwardly from head portion 16. Razor head 16 is disposed in transversely extending recess or well 20 in the upper portion of cover 12 and upstanding spaced projections 24 assist in retaining the razor head in that position. Collar structure 26 at the base of cover 12 has internal coupling elements that engage the chine or bead at the upper end of can 10. Two spaced members 28 extend laterally outwardly from collar 26 and receive handle 18 in releasable interference fit relation therebetween.

The illustrated razor 14 is of the type shown in U.S. Pat. No. 3,832,774 and has an elongated handle portion 18 that is of generally square cross section as indicated in FIG. 9; a neck portion 30 (FIG. 6) which extends forwardly and upwardly from the upper end of grip portion 18; and a head portion 16 that includes transversely extending coupling runner structure 32 on which is disposed a replaceable blade unit 34.

With reference to FIGS. 2–5, cover 12 is molded of suitable plastic such as a high density polyethylene and has a wall thickness of about one millimeter. The cover includes a flat upper surface 36 and a cylindrical skirt 38 that extends to collar 26. The razor head receiving well 20 is formed in the upper portion of cover 12 and is bounded by vertical rear surface 40, horizontal base surface 42, retention projections 24 at its outer wall, and end wall portions 44. A gap 46 is provided in the outer wall of well 20 between the adjacent side surfaces 48 of retention projections 24. Formed within well 20 (on either side of gap 46) are two horizontal support surfaces 50, each about one-quarter centimeter in width and disposed about one-third centimeter below the upper end of retention member 24. The gap 46 between projections 24 is about one centimeter wide and its base is formed by two inclined surfaces 52, 54 that meet at ridge 56. Extending down along the skirt towards collar 26 as an extension of gap 46 is an inclined surface 58 against which the razor handle 18 rests in storage. Well 20 is configured so that the razor head 16 is disposed entirely within the well and below the upper cap surface 36, and the blade edge or edges carried by the razor head 16 are protected against damage or accidental dislodgement while the razor is supported on the dispensing package. End walls 44 are dimensionsed to prevent the inadvertent dislodgement of the blade cartridge 34 from the razor handle while the razor is stored on cover 12.

The handle retention structure includes the two integral projections 28 that are spaced about one centimeter apart and extend about one centimeter radially outward from collar 26. Formed at the outer end of the facing surface of each projection is a latch portion 60 about one-quarter millimeter in height and about one-half centimeter in length. A series of spaced integral coupling elements 62 at the lower edge of the inner surface of collar 26 engage container chine 64 to secure cover 12 to container 10. A gap 66 in the collar 26 between projections 28 exposes chine 64 so that razor handle 18 lies against that chine 64 in a compact storage arrangement when the razor is secured on the dispensing package as indicated in FIG. 6.

FIGS. 6–9 show further details of the razor 14 in supported relation on the dispensing package 10, the coupling structure 32 of the head 16 being carried on support surfaces 50 (as indicated in FIG. 7) and being engaged in retaining relation by the inclined inner surfaces 68 of retention projections 24 (as indicated in FIGS. 7 and 8), the neck 30 of the razor disposed in gap 46, an upper surface of the handle resting against cover surface 58 (as indicated in FIG. 6), and an intermediate portion of the handle secured between latch projections 60 (as indicated in FIG. 9). The razor is supported on support surfaces 50 within well 20 and retained in the well by projections 24 while the handle 18 is secured by latch projections 28.

The razor is conveniently and easily removed from its storage position merely by rotating the base of handle 18 upwardly in a counterclockwise direction as viewed in FIG. 6 to release the handle from the latch projections 28 and then the razor 14 is lifted from well 20 clear of retention projections 24. After shaving, the razor is easily repositioned in secure storage position by lowering the razor head 16 into well 20 and then rotating the handle inwardly so that projections 28 latch handle 18.

The invention thus provides convenient, accessible, compact and secure razor storage in conjunction with a shaving or other product. It will be apparent that a variety of cover shapes may be employed within the scope of the invention, and that storage arrangements for various razors in addition to the type shown in FIG. 1 may be provided. While a particular embodiment of the invention has been shown and described, numerous modifications will be apparent to those skilled in the art, and therefore it is not intended that the invention be limited to the disclosed embodiment or to details thereof, and departures may be made therefrom within the spirit and scope of the invention.

What is claimed is:

1. A razor storage arrangement comprising a container having a dispensing opening at its upper end, a protective cover for removable securance to said container in protective position over said dispensing opening, and a razor having an elongated handle and a head at one end of said handle, said head having portions that extend laterally on either side of said handle for support of a transversely extending shaving edge, a recess in said cover for receiving the head of said razor with said handle extending downwardly below said cover along the side of said container, and structure integral with said cover and complementary with said razor for retaining said razor in releasably supported relation on said container.

2. The arrangement as claimed in claim 1 wherein said cover includes handle retention structure below said recess.

3. The arrangement as claimed in claim 2 wherein said handle retention structure includes two spaced members that project outwardly from said cover, said razor handle being received therebetween in releasably secured relation.

4. The arrangement as claimed in claim 1 wherein said complementary razor retaining structure includes two portions that are spaced apart and receive said razor handle therebetween.

5. The arrangement as claimed in claim 1 wherein said container further includes a dispensing actuator adjacent said dispensing opening and said recess is a well that is above said dispensing actuator when said cover is on said container, said well being dimensionsed to receive the entire head of said razor, and said complementary razor retaining structure includes an upstanding member that extends above said well.

6. The arrangement as claimed in claim 5 and further including a support surface in said well on which a lateral portion of said razor head rests.

7. A razor storage arrangement comprising a container having a dispensing opening at its upper end, a protective cover for removable securance to said container in protective position over said dispensing opening, said cover being a molded plastic member that includes an upper surface, a skirt portion with container coupling structure at the base of said skirt portion, and a razor having an elongated handle and a head at one end of said handle, said head having portions that extend laterally on either side of said handle and carrying a transversely extending shaving edge, a well in said cover for receiving the head of said razor with said handle extending downwardly below said cover along the side of said container, said well having end wall portions that prevent accidental dislodgement of a blade unit secured to said razor head and being dimensioned so that said razor head is disposed within said well and entirely below the upper surface of said cover when said razor is stored on said container, and resilient handle retention structure below said well and integral with said cover and complementary with said razor such that said razor is retained in releasably supported relation on said container with said transversely extending shaving edge protectively housed in said well.

8. The arrangement as claimed in claim 7 wherein said cover has an annular collar flange at the base of said skirt, said container coupling structure includes a plurality of latch elements on the inner surface of said collar flange that resiliently engage container chine structure, said handle retention structure includes two spaced members that project outwardly from said collar flange, said razor handle being received therebetween in releasably secured relation.

9. The arrangement as claimed in claim 8 wherein a support surface is provided in said well on which a lateral portion of said razor head rests and said complementary razor retaining structure includes two upstanding spaced apart portions at the outer edge of said well and extending above said support surface, said upstanding portions defining a gap in which the upper end of said razor handle is disposed, and said skirt portion having a surface portion extending below said gap against which the razor handle rests in storage.

10. A container cover for storing a razor that has an elongated handle and a head at one end of the handle, said head having portions that extend laterally on either side of the handle for support of a transversely extending shaving edge, comprising a molded plastic member that includes an upper surface, a skirt portion with container coupling structure at the base of said skirt portion, a recess in the cover for receiving the head of the razor with the razor handle extending downwardly below the cover, and structure integral with the cover and complementary with the razor for releasably retaining the razor in supported relation on the container when the cover is on the container.

11. The cover as claimed in claim 10 and further including handle retention structure below said recess.

12. The cover as claimed in claim 11 wherein said handle retention structure includes two spaced, resilient members that project outwardly from said cover, said razor handle being received therebetween in releasably secured relation.

13. The cover as claimed in claim 10 wherein said recess is a well dimensioned to receive the entire head of said razor, and said complementary razor retaining structure includes an upstanding member that extends above said well.

14. The cover as claimed in claim 13 and further including a support surface in said well for receiving a lateral portion of said razor head and an end wall portion at either end of said well.

15. A container cover for storing a razor that has an elongated handle and a head at one end of the handle, said head having portions that extend laterally on either side of the handle for support of a transversely extending shaving edge, comprising a molded plastic member that includes an upper surface, a skirt portion with container coupling structure and flange structure at the base of said skirt portion, said container coupling structure including a plurality of latch elements on the inner surface of said flange structure for resiliently engaging container chine structure, said flange structure having a gap through which said container chine structure is exposed, a well in the cover for receiving the entire head of the razor with the razor handle extending downwardly below the cover, a support surface in said well for receiving a lateral portion of said razor head, two upstanding spaced apart portions at the outer edge of said well that extend above said support surface, said upstanding portions defining a gap in which the upper end of said razor handle is disposed when the razor is stored on said cover and handle retention structure integral with the cover and including two spaced members that project outwardly from either side of said gap in said flange structure for receiving a razor handle therebetween in releasably secured relation so that a razor may be releasably retained in supported relation on the container when the cover is on the container.

16. The cover as claimed in claim 10 and further including flange structure at the base of said skirt, said container coupling structure includes a plurality of latch elements on the inner surface of said flange structure that resiliently engage container chine structure, said flange structure having a gap through which said container chine structure is exposed, said handle retention structure includes two spaced members that project outwardly from either side of said gap in said flange structure for receiving a razor handle therebetween in releasably secured relation.

* * * * *